United States Patent [19]

Viehrig et al.

[11] 4,406,534

[45] Sep. 27, 1983

[54] ARRANGEMENT FOR TRANSFERRING PHOTOSENSITIVE MATERIAL FROM CASSETTES INTO A HANDLING MACHINE

[75] Inventors: Wolfgang Viehrig, Munich; Willy Engels, Leverkusen, both of Fed. Rep. of Germany

[73] Assignee: Agfa-Gevaert AG, Leverkusen, Fed. Rep. of Germany

[21] Appl. No.: 296,521

[22] Filed: Aug. 26, 1981

[30] Foreign Application Priority Data

Sep. 10, 1980 [DE] Fed. Rep. of Germany ..... 3034085

[51] Int. Cl.[3] ..... G03D 13/00

[52] U.S. Cl. ..... 354/310; 354/319; 354/354

[58] Field of Search ..... 354/307, 310, 311, 312, 354/313, 314, 315, 316, 354, 277, 275, 319, 320, 321, 322; 242/71.1; 352/75

[56] References Cited

U.S. PATENT DOCUMENTS

| | | | |
|---|---|---|---|
| 3,195,438 | 7/1965 | Woodcock | 354/310 |
| 3,603,528 | 9/1971 | Kingsley | 352/75 |
| 4,067,034 | 1/1978 | Kwiatkowski | 354/307 |
| 4,218,123 | 8/1980 | Viehrig et al. | 354/310 |

*Primary Examiner*—Alan Mathews

*Attorney, Agent, or Firm*—Michael J. Striker

[57] ABSTRACT

An arrangement for transferring photosensitive materials from cassettes of different types and configurations into the interior of a handling machine, such as a developing machine, includes an external wall of the machine which is provided with an input slot, and a plurality of support members which are interchangeably mountable, in a light-sealing manner, at a region of the external wall which surrounds the input slot. Each of the support members is provided with a through opening which registers with the input slot in the mounted position of the respective support member. Each of the support members has a receiving side which is configurated compatibly with a portion of a cassette of a certain type so that the latter portion can be introduced into the receiving side of its associated support member and establish a light-sealing contact therewith. Holding members may be provided on the support member which cooperate with compatible portions of the cassette to hold the latter on the support member. The external wall may carry mounting members, at least one of which may be movable or pivotable, which mount the support member on the external wall. A detecting pin adapted to operate an activating microswitch is displaceably mounted on the external wall and passes through a passage of the support member into engagement with the respective cassette.

11 Claims, 2 Drawing Figures

ARRANGEMENT FOR TRANSFERRING PHOTOSENSITIVE MATERIAL FROM CASSETTES INTO A HANDLING MACHINE

BACKGROUND OF THE INVENTION

The present invention relates to an arrangement for transferring photosensitive materials from cassettes of different types and configurations into a handling machine in general, and more particularly to an arrangement for transferring rolled strip-shaped photographic materials, such as photographic paper strips, into a developing machine.

There are already known arrangements of this type which are capable of transferring the photosensitive material from the respective cassette into the interior of the developing machine without damage thereto, especially without letting ambient light reach the material during its transfer. Such arrangements usually include a slot in an external wall of the machine, a pair of rollers disposed in the interior of the machine in alignment with the slot, and an input part disposed at the region of the external wall surrounding the slot and capable of cooperating with the respective cassette to prevent ambient light from reaching the slot.

One developing machine equipped with such arrangement is disclosed in the published German application DE-OS No. 27 48 480. In this machine, cassettes accommodating paper strips and having different dimensions can be introduced into the interior of a light-impermeably closable housing. However, such an adaptor housing is suited for use for cassettes of a single manufacturer, in that the abutment surface for the front surface of the cassette must be provided with depressions or recesses which are specific to and compatible with cassettes of certain configurations. Therefore, a different adaptor housing has to be provided for cassettes made by each manufacturer. In addition thereto, the adaptor housings are somewhat difficult to handle and take up a considerable amount of space in storage but especially in front of the exposed wall of the developing machine where space may be at a premium.

SUMMARY OF THE INVENTION

Accordingly, it is a general object of the present invention to avoid the disadvantages of the prior art.

More particularly, it is an object of the invention to provide an arrangement for transferring strip-shaped photosensitive materials from cassettes of different types and configurations into the interior of a handling machine, which arrangement is not possessed of the drawbacks of the conventional arrangements of this type.

Still another object of the present invention is to so construct the arrangement of the type here under consideration as to be simple in construction, inexpensive to manufacture, easy to use, and reliable nevertheless.

In pursuance of these objects and others which will become apparent hereafter, one feature of the present invention resides, briefly stated, in an arrangement for transferring photosensitive materials, especially rolled photographic paper strips, from cassettes of various types having different external configurations into the interior of a handling, especially developing, machine for the photosensitive material, in a combination comprising an external wall of the machine having at least one slot for the passage of the photosensitive materials therethrough; and a plurality of support members exchangeably juxtaposable in a light-impermeable manner with a region of the external wall surrounding the inlet slot and each having an opening registering with the inlet slot in the juxtaposed position and a light-sealing portion compatible with one of the cassette types and preventing ambient light from reaching the opening when in contact with the respective cassette.

A particular advantage resulting from the use of the above-mentioned construction is that, when a change is to be made from one cassette type to another, it is merely necessary to exchange the support member which is connected to the exposed wall of the machine by simple mounting means, such as latching or snap-on mechanisms. Then, the respective cassette can be assembled with its associated support member without any need for taking special measures.

Advantageously, the sealing portion is constructed as a circumferentially complete sealing projection which surrounds a portion of the respective cassette that is then juxtaposed with the respective support member. It is also advantageous when each of the support members includes a depression at the sealing portion for partially receiving the respective cassette.

According to a further aspect of the invention, each of the support members includes means for holding the respective cassette in sealing contact with its sealing portion. Such holding means is advantageously compatible with the respective cassette type to cooperate with associated portions of the respective cassette in holding the latter on the respective support member.

When the respective cassette is of the type having a closable slit for the passage of the photosensitive material therethrough after the slit has been opened from the outside, it is advantageous when the support member for this cassette type is provided with means for opening the slit upon juxtposition of the respective cassette with the respective support member.

A further advantageous feature of the present invention which is useful when the handling, especially developing, machine includes an activating switch and a detecting member mounted on the machine for displacement between two positions in one of which it actuates the activating switch, resides in the provision of a passage in the respective support member, this passage partially receiving the detecting member in such a manner that the latter is engaged and displaced from a first into a second of its positions by the respective cassette during assembly of the latter with the respective support member that is then juxtaposed with the aforementioned region of the external wall of the machine.

According to a further facet of the invention, there are further provided means for mounting the respective support member at the aforementioned region of the external wall in an interchangeable manner. Such mounting means may advantageously include at least one mounting member which is mounted on the external wall of the machine at the aforementioned region thereof for movement, especially for pivoting movement, relative thereto into and out of engagement with the respective support member, and means, especially electrically operated means, for moving or pivoting this movable or pivotable mounting member between its engaging and disengaging positions. The movable or pivotable mounting member may cooperate with at least one additional mounting member which is also arranged at the aforementioned region of the external wall of the handling machine and is stationary relative thereto or even integral therewith in mounting the respective support member at the aforementioned region of the external wall.

The novel features which are considered as characteristic of the invention are set forth in particular in the appended claims. The improved arrangement for transferring photosensitive strip-shaped materials from cassettes of different types and configurations into the interior of a handling machine itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
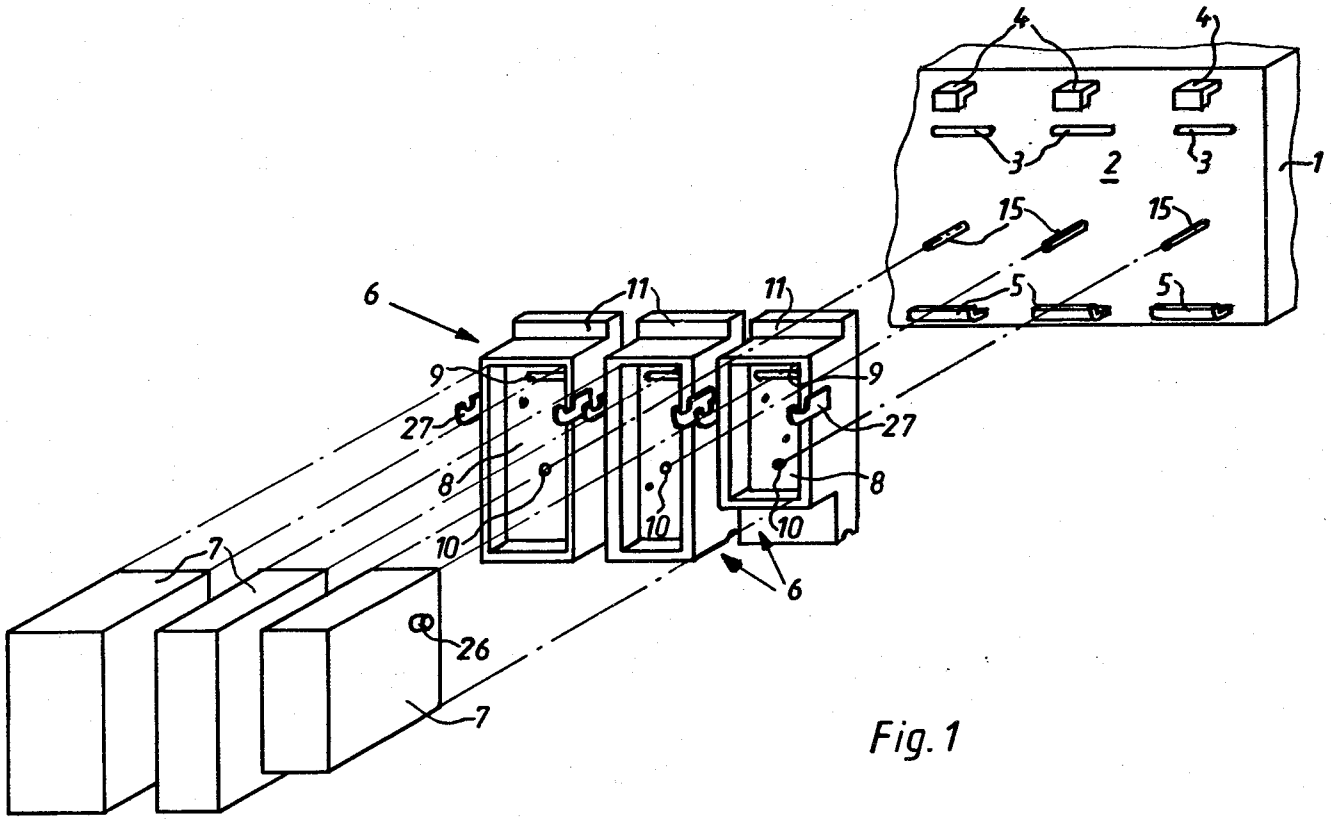
FIG. 1 is an exploded perspective view of an arrangement according to the present invention.

Referring now to the drawing in detail, and first to FIG. 1 thereof, it may be seen that the reference numeral 1 has been used therein to identify an input part of a photographic developing machine. The input part 1 includes an exposed wall 2 provided with input slots 3. Of course, any desired number of such slots 3 can be provided in the exposed wall 2, so long as this number is the same as the number of separate paths through the developing machine. The external wall 2 further supports mounting means or members 4 and 5 which are so situated and constructed as to be able to engage a respective support member 6 and mount the same at the external wall 2 in juxtaposition with a region of the latter surrounding the respective input slot 3.

The support members 6 have different dimensions and shapes, and each of them has a receiving side 8 of a different configuration which is compatible with a respective type of a cassette 7. A through opening or slot 9, and a detecting member accommodation passage 10 are provided in each of the support members. In addition thereto, projections 11 or 12 are respectively provided at the upper and at the lower end of the respective support member 6, these projections 11 and 12 serving as aids in mounting the support members 6 on the external wall 2 of the input part 1 of the developing machine.

Figure 2:
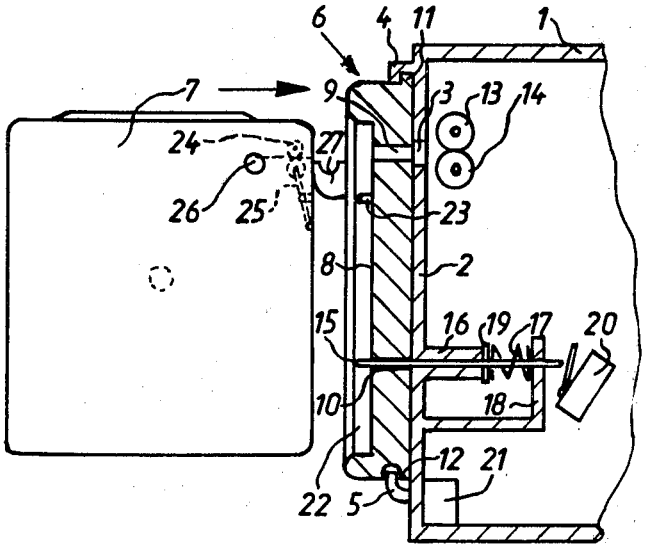
FIG. 2 is a partially sectioned side elevational view of the arrangement of FIG. 1 in its partially assembled condition.

As may be seen particularly in FIG. 2 which shows one of the support members 6 in its mounted position on the external wall 2, as well as the respectively associated or compatible cassette 7 which is shown as being at a small distance from the respective support member 6, the respective support member 6 engages the external wall 2 of the input part 1 of the developing machine in a light-impermeable manner. In the mounted position of the support member 6, in which it covers a predetermined region of the external wall 2 surrounding the input slot 3, the through opening or slot 9 of the support member 6 registers with the input slot 3 of the external wall 2. A pair of transporting rollers 13 and 14 is arranged in the interior of the input part 1 in alignment with the input slot 3. These rollers 13 and 14 cooperate with one another in withdrawing the photosensitive material from the respective cassette 7 after the leading portion of such material has been introduced therebetween.

A detecting member or pin 15 is mounted in a guide 16 of the external wall 2 for displacement longitudinally thereof and it extends beyond the external wall 2 and into and beyond the passage 10 so long as the respective cassette 7 is remote from the respective support member 6. A compression spring 17 abutting against a wall portion 18 integral with the exposed wall 2 at one of its ends and against a collar 19 rigidly connected to the detecting member 15 at its other end urges the detecting member 15 into its illustrated extended position in which it extends, as already mentioned above, beyond the passage 10 and thus beyond the receiving side 8 of the respective support member 6. The other end of the detecting member 15 is aligned with a microswitch 20 which is incorporated in an electronic control device for controlling the operation of the developing machine, which has been omitted from the drawing in order not to unnecessarily encumber the same.

While the upper mounting means or member 4 for the respective support member 6 is made rigid with the exposed wall 2, the lower mounting means or member 5 is connected with a pivoting mechanism 21 which is operative for drawing or pulling the portion of the respective support member 6 which is engaged by the lower mounting member 5 toward the exposed or external wall 2.

The receiving side 8 of the respective support member 6 further includes a circumferentially complete light-sealing ridge 22 which bounds a depression at the receiving side 8 and light-sealingly surrounds a portion of the specially configurated associated cassette 7 after the latter has been fully introduced into the depression. In addition thereto, a pin or bolt 23 is provided at the receiving side 8 of the support member 6. The pin 23 engages and acts on a transmission element 25 of the respective cassette 7 during the introduction of the latter into the receiving side of the respective support member 6 in such a manner that the transmission element 25 opens a closure 24 for the outlet opening or slot of the cassette 7.

Various elements and portions are provided on conventionally configurated cassettes for the purpose of holding the same on or in a treating device or machine. For instance, short stubs or pins 26 can be provided on the respective cassette 7, as shown in FIG. 2, at the region of the outlet opening or slot thereof. Then, the respective support member 6 especially designed for this cassette type may include holding hooks 27 on which the stubs 26 reset after the introduction of the cassette 7 into the receiving side 8 of the support member 6. As a result of this suspension of the cassette 7 at its upper region, the gravitational forces acting thereon will press the cassette 7 against the receiving side 8. Of course, different types of cassettes have different kinds of male or female holding portions or elements, and the respective support members will then be provided with conpatibly or complementarily configurated female or male holding members or portions co-operating therewith in order to hold the cassette 7 of the respective type securely in its inserted position on the support member 6.

During the operation of the transferring arrangement of the present invention, a support member 6 corresponding to the cassette type then to be handled is first juxtaposed with the external wall 2 of the input part 1 of the handling machine, and then is arrested in its position by means of the mounting members 4 and 5. At this time, the respective cassette 7 can be assembled with the thus mounted support member 6 in that the pins 26 are first introduced into the hooks 27 and then the cassette 7 is released or pushed into the depression bounded by the ridge 22, so that it comes into light-sealing contact with the support member 6 at the receiving side 8. The pin 23 provided at the receiving side 8 opens the closure 24 for the cassette outlet opening or slot, whereupon the leading end portion of the strip-shaped photo-sensitive material accommodated in the cassette 7, such as photosensitive paper strip, is withdrawn, in a conventional manner and by means of conventional arrangements which have not been shown in the drawing, from the cassette 7, passed through the opening or through slit 9 of the support member 6 and the input slot 3 of the external wall 2 of the input part 1 of the developing machine, and introduced between the rollers 13 and 14.

During the introduction of the cassette 7 into the receiving side 8 of the support member 6, the detecting pin 15 is depressed or displaced opposite to the action of the compression spring 17 thereon, so that it actuates the activating microswitch 20. In this manner, a signal is supplied to the developing machine, this signal indicating that a new cassette 7 has been introduced into the receiving side 8 of the support member 6. Thereafter, and following the clamping of the leading end portion of the paper strip or band between the rollers 13 and 14, withdrawal of the paper strip from the cassette 7 can be commenced in an automatic manner, as is well known in the art. The automatic control of the operation of the developing machine is performed by a conventional electronic control arrangement which receives signals from various sensors and issues command signals for controlling the operation of the machine.

When all or substantially all of the strip-shaped material is withdrawn from the respective cassette, a sensor constituting an additional component of the electronic control unit or arrangement issues a signal indicative of this condition, which triggers the performance of various measures, such as the activation of a warning device, and the stoppage of rotation of the rollers 13 and 14 or the like, depending on the construction of the developing machine. The readiness for treatment of a further strip-shaped material is established only by a new operation of the detecting pin 15 and of the activating microswitch 20, which occurs in response to the introduction of a new cassette 7. It is of no consequence that the support member 6 may have been replaced in the meantime by another one, inasmuch as the replacement support member 6, because of the relatively large dimensions of the passage 10 thereof, does not displace the detecting pin 15 into its retracted position in which it would actuate the microswitch 20.

Interfering means may further be provided on the respective support member 6, the purpose of such interfering means being to interfere with or prevent the introduction into the receiving side 8 of the respective support member 6 of cassettes 7 which have similar dimensions or configurations as those cassettes 7 for which the respective support member 6 is designed. It is further conceivable and contemplated by the present invention that the cassettes 7 may be provided with certain identification markings or characteristic formations or the like which convey information about the material accommodated in the cassette 7 or about other features which may be important, for instance, in handling or developing the material. Then, the machine itself can be provided with means for deciphering this information, and the support members could be provided with similar markings or formations arranged at locations corresponding to those of the cassette 7 so as to be detectable by the deciphering means of the machine. Another possibility is to provide the support members 6 with means for transmitting such information, such transmitting means being, for instance, similar to the detecting pin or member 15, which would sense the presence or absence of such markings or formations on the cassette 7 and transmit such information eventually to the machine electronic control arrangement.

It will be understood that each of the elements described above, or two or more together, may also find a useful application in other types of arrangements differing from the type described above.

While the invention has been illustrated and described as embodied in an arrangement for transferring convoluted photosensitive paper strips from cassettes of different types and configurations into the interior of a developing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an arrangement for transferring photosensitive materials from cassettes of various types having different external configuration into the interior of a handling machine for the photosensitive materials, a combination comprising an external wall of the machine having at least one inlet slot for the passage of the photosensitive materials therethrough; a plurality of support members exchangeably juxtaposable in a light-impermeable manner with a region of said external wall surrounding said inlet slot and each having an opening registering with said inlet slot in the juxtaposed position and a light-sealing portion compatible with one of the cassette types and preventing ambient light from reaching said opening when in contact with the respective cassette, and each including means for holding the respective cassette in contact with said sealing portion thereof; and means for mounting the respective support member at said region of said external wall.

2. The combination as defined in claim 1, wherein said sealing portion is a circumferentially complete sealing projection surrounding a portion of the respective cassette which is then juxtaposed with the respective support member.

3. The combination as defined in claim 1, wherein each of said support members includes a depression at said sealing portion for partially receiving the respective cassette.

4. In an arrangement for transferring rolled photographic paper strips from cassettes of the types having different external configurations but having a closable slit for passage of the photographic paper strip therethrough into the interior of a developing machine for the photographic paper strips, a combination comprising an external wall of the machine having at least one inlet slot for the passage of the photographic paper strip therethrough; a pluarlity of support members exchangeably juxtaposable in a light-impermeable manner with a region of said external wall surrounding said inlet slot and each having an opening registering with said inlet slot in the juxtaposed position and a light-sealing portion compatible with one of the cassette types and preventing ambient light from reaching said opening when in contact with the respective cassette; and means on the respective support member for opening said slit upon juxtaposition of the respective cassette with the respective support member.

5. The combination as defined in claim 4, wherein each of said support members includes means for holding the respective cassette in contact with said sealing portion thereof.

6. The combination as defined in claim 1, including an activating switch and a detecting member mounted on the machine for displacement between two positions in one of which it actuates the activating switch, wherein the respective support member has a passage for partially receiving the detecting member so as to be engaged and displaced from a first into a second of said positions by the respective cassette during assembly of the latter with the respective support member then juxtaposed with said region of said external wall.

7. The combination as defined in claim 4; and further comprising means for mounting the respective support member at said region of said external wall.

8. In an arrangement for transferring rolled photographic paper strips from cassettes of various types having different external configurations into the interior of a developing machine for the photographic paper strips, a combination comprising an external wall of the machine having at least one slot for the passage of the photographic paper strip therethrough; a plurality of support members exchangeably juxtaposable in a light-impermeable manner with a region of said external wall surrounding said inlet slot and each having an opening registering with said inlet slot in the juxataposed position and a light-sealing portion compatible with one of the cassette types and preventing ambient light from reaching said opening when in contact with the respective cassette; and means for mounting the respective support member at said region of said external wall, including at least one mounting member mounted on said external wall for pivoting movement relative thereto into and out of engagement with the respective support member, and electrically operated means for pivoting said mounting member.

9. The combination as defined in claim 8, wherein said mounting means further includes at least one additional mounting member stationary with respect to said external wall and co-operating with the respective support member and with said one mounting member in mounting the respective support member at said region of said external wall.

10. In an arrangement for transferring photosensitive materials from cassettes of the types having different external configurations but having a closable slit for passage of the photosensitive material therethrough into the interior of a handling machine for the photosensitive materials, a combination comprising an external wall of the machine having at least one inlet slot for the passage of the photosensitive material therethrough; a plurality of support members exchangeably juxtaposable in a light-impermeable manner with a region of said external wall surrounding said inlet slot and each having an opening registering with said inlet slot in the juxtaposed position and a light-sealing portion compatible with one of the cassette types and preventing ambient light from reaching said opening when in contact with the respective cassette; and means on the respective support member for opening said slit upon juxtaposition of the respective cassette with the respective support member.

11. In an arrangement for transferring photosensitive materials from cassettes of various types having different external configurations into the interior of a handling machine for the photosensitive materials, a combination comprising an external wall of the machine having at least one slot for the passage of the photosensitive material therethrough; a plurality of support members exchangeably juxtaposable in a light-impermeable manner with a region of said external wall surrounding said inlet slot and each having an opening registering with said inlet slot in the juxtaposed position and a light-sealing portion compatible with one of the cassette types and preventing ambient light from reaching said opening when in contact with the respective cassette; and means for mounting the respective support member at said region of said external wall, including at least one mounting member mounted on said external wall for pivoting movement relative thereto into and out of engagement with the respective support member, and electrically operated means for pivoting said mounting member.

* * * * *